US005439400A

United States Patent [19]

Kozel et al.

[11] Patent Number: 5,439,400

[45] Date of Patent: Aug. 8, 1995

[54] DISPOSABLE ELECTRICAL CONNECTOR HEADER

[75] Inventors: Charles A. Kozel, McHenry; Daniel P. Vladic, Antioch, both of Ill.

[73] Assignee: Methode Electronics, Inc., Chicago, Ill.

[21] Appl. No.: 85,979

[22] Filed: Jul. 1, 1993

[51] Int. Cl.[6] ..... H01R 9/24; H01R 13/424

[52] U.S. Cl. ..... 439/885; 206/443

[58] Field of Search ..... 439/83, 876, 885; 269/903; 228/44.7, 180.1; 206/328, 382, 383, 443, 485, 488

[56] References Cited

U.S. PATENT DOCUMENTS

| | | | |
|---|---|---|---|
| 3,673,543 | 6/1972 | Garner | 206/328 X |
| 5,083,696 | 1/1992 | Kan et al. | 228/44.7 |
| 5,169,347 | 12/1992 | Sang | 439/885 |
| 5,176,254 | 1/1993 | Caravona | 206/328 |
| 5,242,311 | 9/1993 | Seong | 439/83 X |

OTHER PUBLICATIONS

Methode Electronic Inc.'s brochure entitled "Disposable Insulator Headers".

*Primary Examiner*—Steven C. Bishop

*Attorney, Agent, or Firm*—David L. Newman

[57] ABSTRACT

A disposable electrical connector header includes a base portion having a plurality of pin-receiving passages being open on one side. An external adjacent spring member to the open side of the passages provides an interference fit when a terminal pin is inserted from the bottom of the base portion of the disposable header. A plurality of terminal pins are received in the passages and project from the disposable header for insertion into holes in a printed circuit board and for solder connection to circuit traces on the circuit board. The disposable header is then slid off the terminal pins after soldering to the printed circuit board. A top portion is also provided having pin stops located correspondingly above each of the passages to restrict the movement of the terminal pins once inserted into the passages of the disposable header. A flat top at the upper portion of the disposable header is provided for robotic placement or removal of the disposable header.

8 Claims, 1 Drawing Sheet

DISPOSABLE ELECTRICAL CONNECTOR HEADER

BACKGROUND OF THE INVENTION

The present invention relates to electrical connectors and particularly, to a header which temporarily holds pins until the pins are soldered to a printed circuit board at which time the header may be removed from the pins and disposed of. The use of a header as a method of electrically connecting a printed circuit board to a female connector is well known. Terminal pins are perpendicularly inserted into the header for transport and placement of the pins onto a printed circuit board in a desired configuration. The terminal pins may be configured within a header in rows of varying length along the header. The terminal pins are inserted into passages in the header allowing the terminal pins to protrude from the passages a predetermined distance. The header is then used to locate and insert the terminal pins into corresponding holes of a primed circuit board. The pins are then soldered to circuit traces on the printed circuit board or in the holes. The header may then be removed, or slid off of the pins and disposed of. The terminal pins are then free to mate with a female connector.

Such a header device is disclosed in U.S. Pat. No. 5,083,696, disclosing the retention of the terminal pins within the header by frictional force between the four walls of the passages of the header and the terminal pins. Also disclosed is a projecting portion of the terminal pin which engages the passages of the header in order to retain the terminal pin within the header. However, such headers that are known in the art do not disclose an external means of providing an interference fit of the terminal pins to ensure uniform pin retention regardless of pin tolerance and plating variations. Nor does the prior art disclose a means for prohibiting the vertical movement of the terminal pins beyond a specific point during shipment or placement on a printed circuit board. Nor is it shown to provide a header having a flat top facilitating the robotic placement and removal of the header.

SUMMARY OF THE INVENTION

A disposable electrical connector header for temporarily retaining terminal pins in a predetermined array comprising a header assembly including a base having longitudinal pin-receiving passages adjacent external pin retention spring members and a top having pin stop areas and a flat upper surface. The pin retention spring members are positioned adjacent the fourth open side of the pin-receiving passages and are angled slightly inward to the passages and are integral with the header base. The base also includes stand-off members along the bottom. The header top includes a pin stop which is located above each of the pin-receiving passages a predetermined distance above the passages by varying the height of the top portion. In an alternative embodiment, the top portion may also include a top tab for removal of the header by fingertip placement on the top tab. The passages may include chamfered lead in areas at the base of the header. The pin stops located along the length of the top of the header form perpendicular flanges which are flush with the side of the base of the header.

A principal object of this invention is to provide a disposal header having interference members which are external to the pin-receiving passages and separate from the passages.

It is another object of this invention to provide a disposable header having a top portion which provides a pin stop to prevent pin movement in shipment and handling.

It is a further object of this invention to provide a disposable header which has molded spring members providing interference and retention of terminal pins regardless of pin tolerance and plating variations.

It is another object of this invention to provide a convenient, accessible top portion for easy removal of the insulator after soldering.

DESCRIPTION OF THE DRAWINGS

There is shown in the drawings a preferred embodiment of the present invention, wherein like numerals in the various figures pertain to like elements, and wherein.

DETAILED DESCRIPTION OF THE PRESENTLY PREFERRED EMBODIMENTS

The present invention relates to an improved disposable electrical connector header. The disposable header is better understood by reference to FIGS. 1–3 which show various aspects of a preferred disposable header of this invention.

Figure 1:
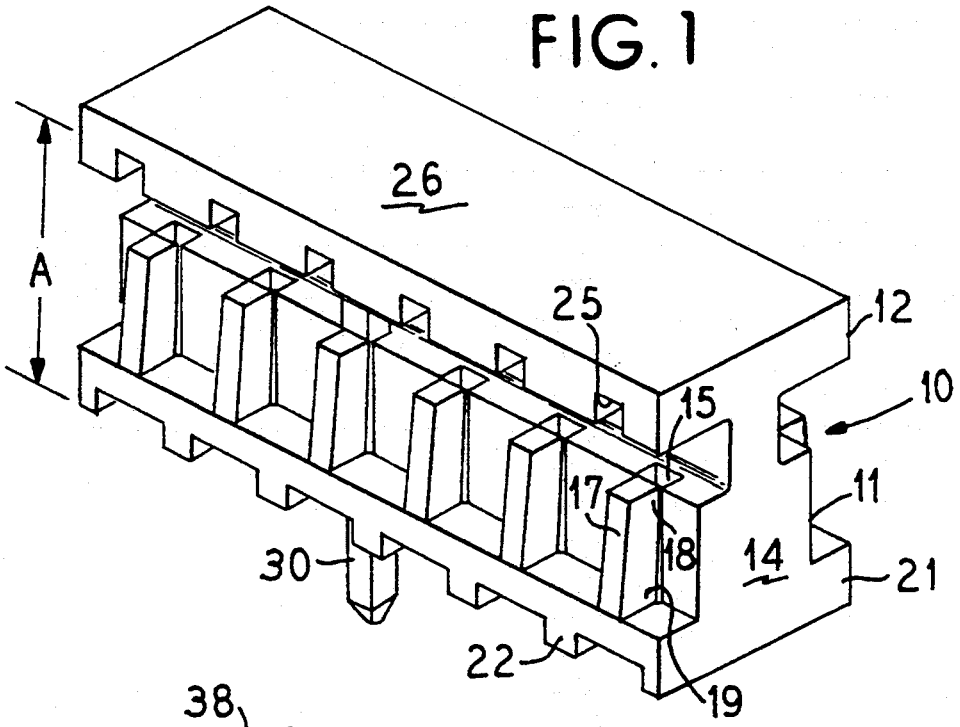
FIG. 1 is a perspective top view of the disposable electrical connector header of this invention.

Turning to FIG. 1, the disposable header 10 is shown having a base 11 and a top 12. The base 11 has along its bottom a platform 21. The header 10 may be formed of any plastic material such as high temperature glass filled polyester. The base 11 includes a central body 14. Spaced along the length of the central body 14 are vertical passages 15. The passages 15 in a preferred embodiment of the header 10 are located along both sides of the central body 14. The passages 15 in a preferred embodiment of the header 10 are U-shaped having the three sides formed within the central body 14. The fourth side of the passages 15 at the outer side of the central body 14 above the platform 21 is open. External to and adjacent to the open side of the passages 15 are spring members 17. The spring members 17 are angled inward toward the passages 15 so that they are encroaching into the passages at the spring member top 18. At the base of the spring member 19 it is separated from the open side of the passages 15 a distance.

The spring members 17 are integrally molded to the header 10 at the platform 21. Also positioned along the length of the platform 21 and along its bottom are standoffs 22 which provide spaces under the header 10 to facilitate for soldering and cleaning after the terminal pins 30 are bonded to a printed circuit board 42.

The top 12 of the header 10 has positioned along its length an underside surface which provides a surface which terminal pins 30 will "stop" against, upon full insertion into header 10. This pin stop 25 surface in the preferred embodiment is shown having protruding walls surrounding the area where the terminal pin 30 abuts the pin stop 25 surface in order to ensure alignment of the terminal pins 30. The top has a flat surface 26 in a preferred embodiment of the present invention to allow for robotic placement and removal via vacuum pick and place loading or removal of the disposable header to or from a printed circuit board prior to or following soldering of terminal pins 30 to a printed circuit board 42 (see FIG. 3). The header 10 is designed so that terminal pins 30 may be inserted into the passages 15 of the header 10 until the terminal pins 30 reach a full-insertion position when the pins 30 are abutting the pin stop 25.

The terminal pins 30 are retained within the passages by the frictional force of the spring members 17 against the outer side of the pin terminals 30 along the open side of the passages 15. The spring members 17 are integrally molded of a plastic material which allows for a resiliency or spring-like characteristic which provides uniform retention of terminal pins 30 in the passages 15 regardless of the terminal pin 30 tolerance or plating variations. The spring members 17 in a preferred embodiment have a minimum deflection of 0.001" and create a uniform pressure against the pins 30. The terminal pins 30 are constructed of any metallic material such as phosphor bronze. Upon insertion of the terminal pins 30 into the passages 15 the terminal pins 30 slide against the spring member top 18 canting the spring members 17 backward away from the passages 15. The pins 30 are inserted until they abut the pin stop 25. The resiliency of the spring members 17 provide an interference fit of the pins 30 retaining the pins 30 in a fully inserted position.

Figure 2:
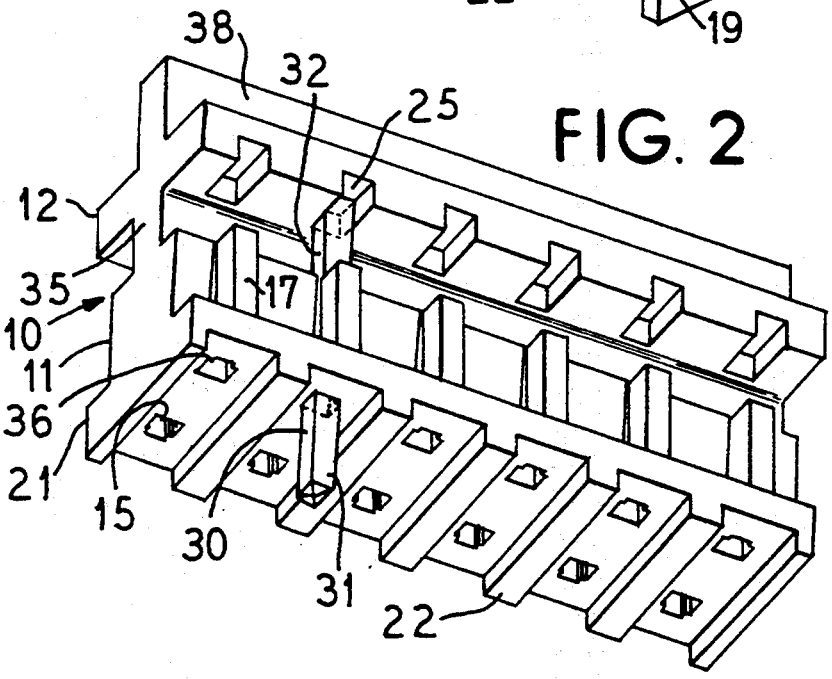
FIG. 2 is a perspective bottom view of a disposable electrical connector header of this invention.

Turning to FIG. 2, the disposable header 10 is viewed from the bottom. The base 11 is shown having at its bottom a platform 21. Positioned along the length of the platform 21 are pairs of passages 15 for receiving terminal pins 30. The terminal pins are inserted from the bottom of the header 10 into the passages 15 and through the passages 15 until the top of the terminal pins 30 abut against the pin stop 25 reaching the fully inserted position of the terminal pins 30. The pin has an end portion 31 which protrudes from the bottom of the disposable header 10 a predetermined length in order for the pin to be inserted into holes of a primed circuit board and successfully attached thereto. The end portion 31 of terminal pin 30 is the portion of the pin which is inserted into and through a printed circuit board 42. The top portion 32 is the length of the terminal pin 30 which remains above the printed circuit board and as the header is removed (FIG. 3) determines the vertical space "A" (FIG. 1) above the PC board that a connector connected to the soldered terminal pins 30 will take up. The header 10 height "A" may be adjusted according to the top portion 32 height requirements by lengthening or shortening the neck 35. Length "A" is increased by increasing the length of neck 35 moving the top 12 higher above the corresponding passages 15 and lengthening the distance that the pin stop 25 is above the corresponding passages 15. Thus, the terminal pins 30 which are inserted therein must be inserted further in order to reach the full insertion point which results in an increased length of top portion 32. The top portion 32 and length "A" may be reduced also by reducing neck 35.

The spring members 17 are integrally molded to the platform 21 of the disposable header 10 so that the spring member base 19 is separated a distance from the open side of the passages 15 which creates a notch 36 at the bottom of the header 10.

FIG. 2 shows an alternative embodiment of the present invention at the top 12 having a top tab 38 for placement or removal of the header 10 from the mounted pins 30 by using fingertips at the top tab 38 to grasp the header 10 to place on a printed circuit board 42 or slide it off the pins 30 after soldering to a printed circuit board. The top tab 38 is integrally molded with the top 12 and header 10.

Figure 3:
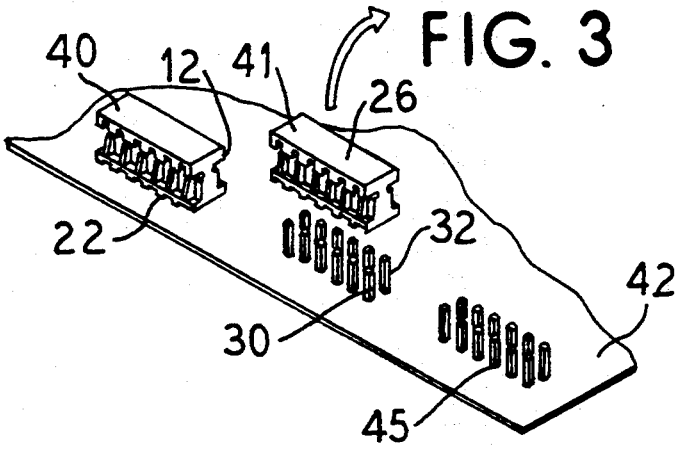
FIG. 3 is a perspective view of disposable electrical connector headers of this invention on a printed circuit board.

Turning to FIG. 3, the steps of attaching the terminal pins to a printed circuit board are shown. A header 40 having terminal pins 30 inserted therein and retained by the spring members 17 are positioned over a printed circuit board 42 having holes in which the array of pins 30 are inserted. The top 12 of the disposable header 40 assures that the terminal pins 30 have uniformly protruding pin ends 31 which have not been moved during shipment having pins 30 fully inserted against the pin stop 25 and retained by the spring members 17. The uniform pin ends are then inserted in the holes of the printed circuit board 42 to a uniform depth, ensuring that all of the terminal pins 30 make uniform contact with the circuit traces of the primed circuit board 42. The terminal pins 30 of the header 40 are then soldered to the printed circuit board 42. Once the connections between the terminal pins 30 and the primed circuit board 42 have cured, the board may be cleaned by running fluid under the disposable header 40 between the stand-offs 22. The header 41 is then removed from the printed circuit board 42 by slipping the header 41 off of the pins 30. The pins 30 remain attached to the primed circuit board 42. The header 41 may be placed onto or removed from the printed circuit board 42 by hand or via robotic equipment by gripping top 12 of the disposable header 41. The pins 45 attached to the printed circuit board 42 are then ready for connection with a female electrical connector.

The removal of the disposable header 41 provides for a connector assembly having the least thickness possible, since the header has been removed. The removal of the disposable header 41 off of the terminal pins 30 is possible because the interference fit between the spring members 17 against the terminal pins 30 is great enough to retain the terminal pins 30 within the header 10 prior to attachment to a printed circuit board 42 but not great enough to overcome the retention force created by the terminals 30 being secured to the printed circuit board 42.

The description above has been offered for illustrative purposes only, and it is not intended to limit the scope of the invention of this application which is defined in the following claims.

I claim:

1. A disposable electrical connector header for temporarily retaining terminal pins in a predetermined array comprising:

a base having longitudinal pin-receiving passages;

spring members external to and adjacent said passages;

a top having a pin stop surface and a longitudinal tab; and a neck of lesser width than said base and protruding from said base supporting said top.

2. A disposable electrical connector header for temporarily retaining terminal pins in a predetermined array comprising:

a base having a platform, a central body and longitudinal pin-receiving passages;

spring members external to and adjacent said passages;

a top having a pin stop surface; and a neck of lesser width than said central body and protruding from said central body supporting said top and providing for the variable positioning of said top above said base.

3. The disposable header of claim 2 wherein: said top having a flat top surface.

4. The disposable header of claim 2 wherein: said top having a longitudinal tab.

5. The disposable header of claim 2 wherein: said spring members integrally molded with said header angled inward toward said passages.

6. The disposable header of claim 5 wherein: said spring members are integral with said base.

7. The disposable header of claim 2 wherein: said top is variably positioned above said base.

8. The disposable header of claim 2 wherein: said pin stop having multiple protruding wails surrounding areas where said terminal pins abut said pin stop surface.

* * * * *